US006296682B1

(12) United States Patent
Uenosono et al.

(10) Patent No.: US 6,296,682 B1
(45) Date of Patent: Oct. 2, 2001

(54) IRON-BASED POWDER BLEND FOR USE IN POWDER METALLURGY

(75) Inventors: Satoshi Uenosono, Chiba; Ji-bin Yang, Niigata, both of (JP)

(73) Assignees: Kawasaki Steel Corporation, Kobe; Mitsubishi Materials Corporation, Tokyo, both of (JP)

( * ) Notice: Subject to any disclaimer, the term of this patent is extended or adjusted under 35 U.S.C. 154(b) by 0 days.

(21) Appl. No.: 09/601,113

(22) PCT Filed: Dec. 22, 1999

(86) PCT No.: PCT/JP99/07211

§ 371 Date: Aug. 16, 2000

§ 102(e) Date: Aug. 16, 2000

(87) PCT Pub. No.: WO00/39353

PCT Pub. Date: Jul. 6, 2000

(30) Foreign Application Priority Data

Dec. 25, 1998 (JP) ..... 10/369045

(51) Int. Cl.[7] ..... B22F 1/00
(52) U.S. Cl. ..... 75/254; 75/252
(58) Field of Search ..... 75/254, 252

(56) References Cited

U.S. PATENT DOCUMENTS 4,437,890 * 3/1984 Hayasaka et al. ..... 75/244
4,491,477 * 1/1985 Suganuma et al. ..... 75/230
5,938,814 * 8/1999 Uenosono et al. ..... 75/254

FOREIGN PATENT DOCUMENTS 7-188872 7/1995 (JP) .
8-120424 5/1996 (JP) .
8-144026 6/1996 (JP) .
8-209202 8/1996 (JP) .
10-280083 10/1998 (JP) .

* cited by examiner

*Primary Examiner*—Ngoclan Mai
(74) *Attorney, Agent, or Firm*—Oliff & Berridge, PLC

(57) ABSTRACT

The object of the present invention is to provide an iron based blended powder for powder metallurgy that can provide a reformable sintered article that has a good sliding property with less variation in the property and a good impact resistance. More specifically, the iron based blended powder for powder metallurgy is formed by blending an atomized alloy iron powder with 0.01% to 1.0% of one or more types of compound powder containing B in terms of B, 1 to 10% of Ni powder, 1 to 6% of Cu powder, 1.3 to 3.0% of graphite powder by weight %, as well as 0.5 to 2.0 parts by weight of a lubricant with respect to 100 parts by weight of the total weight of said powder. The iron based blended powder for powder metallurgy wherein the atomized alloy iron powder comprises, by weight %, 0.03 to 1.00% of Mn, 0.5 to 4.0% of Cr, 0.03 to 0.3% of S, and the residue of Fe and unavoidable impurities, the compound powder containing B and the graphite powder being adhered by means of the lubricant to surfaces of the atomized alloy iron powder.

3 Claims, No Drawings

IRON-BASED POWDER BLEND FOR USE IN POWDER METALLURGY

FIELD OF THE INVENTION

The present invention relates to an iron based blended powder for powder metallurgy. It is more particularly concerned with an iron based blended powder for powder metallurgy which, after having been sintered, provides a reformable sintered article having a good sliding property, less variation in this property, and a good impact resistance.

BACKGROUND ART

The iron based blended powder for powder metallurgy is formed by blending an iron powder with a Cu powder or carbon powder, compacted in a die, and then sintered into a sintered body having ordinarily a density of 5.0 to 7.2 g/cm$^3$ to be used as mechanical parts and so forth. In order to improve the sliding property of a sintered article that is to be used as mechanical parts or the like, such sintered steel as contains free graphite like cast iron is considered effective.

For example, Japanese Patent Laid-Open Publication No. Hei 8-209202 has suggested such a blended powder that provides a sintered article which contains a maximum of 0.5% by weight of free graphite therein and has an improved sliding property. The blended powder is formed by blending an iron power with a graphite powder, the iron powder containing B, Cr, and Mn, as well as one or more elements selected from the group consisting of S, Se, and Te, and a partially alloyed element selected from the group consisting of Ni, Cu, and Mo.

Furthermore, Japanese Patent Laid-Open Publication No. Hei 8-144,026 discloses a structure, of a free graphite precipitate iron based sintered article with high strength and a high toughness, containing C, Ni, Mo, Cu, BN, and S with the residue Fe and unavoidable impurities, said BN being distributed in the boundary faces of said polycrystalline bodies.

However, recently, various types of drive units for use in automobiles or the like have increasingly been required to provide higher output and reduced weight, leading to more extreme conditions for the sliding parts to be used therein, so that sintered articles are required to have still further improved sliding properties.

However, in order to increase the content of free carbon in a sintered article to 0.5% by weight or more, merely increasing the quantity of carbon to be blended into an iron based blended powder for powder metallurgy as set forth in Japanese Patent Laid-Open Publication No. Hei 8-209202 would cause the sintered article to increase in brittleness due to excessive carbonization, thus raising such problems that the impact resistance is reduced and the sintered article cannot be reformed. Furthermore, merely increasing the content of the carbon added to said iron based blended powder for powder metallurgy would cause the carbon to segregate from the iron powder due to the difference in their specific gravity during the transportation of the blended powder or at the time of the feed of the same, thus raising such a problem that sintered articles have variations in sliding properties.

Furthermore, the technique set forth in Japanese Patent Laid-Open Publication No. Hei 8-144026 was intended to obtain as high a toughness as the present invention, however, it has disclosed no data on the sliding property.

DISCLOSURE OF THE INVENTION

Hereupon, the object of the present invention is to overcome the aforementioned prior art problems. It is to provide an iron based blended powder for powder metallurgy that can provide, after sintering, a good reformable sintered article having less variation in properties, which contains Cr for providing a higher wear resistance, has a good sliding property, and has a good impact resistance with an impact value of 6J/cm$^2$.

As the result of intensive study, the present inventors completed the present invention with the findings that the iron based blended powder was suitable as a blended powder for powder metallurgy that can provide, after sintering, a good reformable sintered article having less variation in properties, which contains Cr for providing a higher wear resistance, has a good sliding property, and has a good impact resistance with an impact value of 6J/cm$^2$, which was formed by adhering compounds containing a graphite powder and B to the surface of an atomized alloy iron powder containing Mn, Cr, and S, and containing Mo and V selectively, and was further blended with a Ni powder, a Cu powder, and a lubricant.

(1) An iron based blended powder for powder metallurgy, formed by an atomized alloy iron powder with 0.01% to 1.0% of one or more types of compounds containing B, 1 to 10% of Ni powder, 1 to 6% of Cu powder, 1.3 to 3.0% of graphite powder, by weight % with respect to the total weight of said atomized alloy iron powder, the compound powder containing B, the Ni powder, the Cu powder, and the graphite powder, as well as 0.5 to 2.0 parts by weight of a lubricant with respect to 100 parts by weight of said total weight, the iron based blended powder for powder metallurgy being characterized in that said atomized alloy iron powder comprises, by weight %, 0.03 to 1.00% of Mn, 0.5 to 4.0% of Cr, 0.03 to 0.3% of S, and the residue of Fe and unavoidable impurities, said compound powder containing B and said graphite powder being adhered by means of said lubricant to surfaces of said atomized alloy iron powder.

(2) An iron based blended powder for powder metallurgy according to claim (1), characterized by further containing one or two types of elements selected from the group consisting of 0.05% to 3% of Mo and 0.1 to 0.5% of V.

(3) An iron based blended powder for powder metallurgy according to claim (1) or (2), characterized in that said blended powder satisfies the following equations of (1) and (2):

$$\text{the content of C of a blended powder 75 to 150 } \mu\text{m in a particle diameter/the content of C of the whole blended powder} \geqq 0.5 \quad (1),$$

and $$\text{the content of B of a blended powder 75 to 150 } \mu\text{m in a particle diameter/the content of B of the whole blended powder} \geqq 0.5 \quad (2).$$

The iron based blended powder for powder metallurgy according to the present invention allows, after sintering, the sintered article to contain the content of free carbon of 1% by weight or more. In addition, the iron based blended powder for powder metallurgy makes available a reformable sintered article which has 7.0 kgf/cm$^2$ or more of the maximum allowable load, which has a sliding property in a dried wearing condition, 1.0 kgf/cm$^2$ of the variation in the sliding property (equal to 1 $\sigma$ of the standard deviation), and an impact value of 6J/cm$^2$.

Now, the reason why Mn, Cr, and S, which are contained as preparatory alloys in the atomized alloy iron powder to be used in the present invention, are limited is explained.

The Content of S in the Iron Powder: 0.03 to 0.3% by Weight

This was added to produce free graphite in the sintered article. The S in the iron powder is present as FeS on the surface of the iron powder, having an effect of reducing the surface energy of the iron powder. With a content of S below 0.03% by weight, no effect of increasing the content of free graphite is recognized. On the other hand, with a content of S above 0.3% by weight, the sintered article has a low impact value and further soot is produced that causes the sintered article to be apt to corrosion. In addition, the sintering furnace will be damaged. For this reason, the content of S was limited to 0.03% to 0.3% by weight. It is preferably 0.05% to 0.25% by weight.

The Content of Cr in the Iron Powder: 0.5 to 4.0% by Weight

Cr was added to increase the wear resistance of the sintered article and to reduce the frictional coefficient. With a content of Cr below 0.5% by weight, no effect of the addition can be obtained. However, with a content of Cr above 4.0% by weight, the sintered article becomes too hard to be reformable and to cause the toughness to decrease. For this reason, the content of Cr was limited to 0.5% to 4.0% by weight. It is preferably 0.5% to 2.5% by weight.

The Content of Mn in the Iron Powder: 0.03 to 1.0% by Weight

Mn is an element for reducing free graphite in the sintered article. However, when Cr and S are present at the same time, it is possible to contain Mn of a content of 1.0% by weight. However, with a content of Mn above 1.0% by weight, the content of free carbon in the sintered article becomes less, causing the sliding property to deteriorate. On the other hand, the content of Mn is preferably reduced as much as possible, however, the lower limit of the content of Mn was set to 0.03% by weight in relation to the refining cost required for reducing the content of Mn at the stage of adjusting the melt ingredients of steel. For this reason, the content of Mn was limited to 0.03% to 1.0% by weight. It is preferably 0.1% to 0.8% by weight.

Now, the reason why 0.05 to 3% by weight of Mo and 0.1 to 0.5% by weight of V, which are selectively contained as preparatory alloys in the aforementioned atomized alloy iron powder, are limited to one or two types or more is explained.

Mo is added to increase the strength and impact valves of the sintered article. With a content of Mo below 0.05%, no improvement in the toughness of the sintered article is recognized. Moreover, with a content of Mo above 3%, the sintered article reduces in toughness and becomes too hard to be reformable. For this reason, the content of Mo was limited to 0.05 to 3% by weight.

V as well as Mo, are added to increase the strength and toughness of the sintered article. With a content of V below 0.1%, no improvement in the toughness of the sintered article is recognized. Moreover, with a content of V above 0.5%, the sintered article reduces in toughness and becomes too hard to be reformable.

The reason why the compound powder containing B, the Ni powder, the Cu powder, the graphite powder, and the lubricant, which are blended into said atomized alloy iron powder, are limited is explained.

Hereafter, unless otherwise stated, the blend ratio of the compound powder containing B, the Ni powder, the Cu powder, and the graphite powder are expressed by weight % with respect to the total amount (the amount obtained by subtracting the lubricant from the blended powder) of the atomized alloy iron powder, the compound powder containing B, the Ni powder, the Cu powder, the graphite powder.

In addition, the blend ratio of the lubricant is expressed in parts by weight in relation to 100 parts by weight of the total amount of the atomized alloy iron powder, the compound powder containing B, the Ni powder, the Cu powder, and the graphite powder.

The Blended Amount of One or More Types of Compound Powder Containing B (in Terms of B): 0.01 to 1.0% by Weight The effect of B exerting on the production of free graphite is not yet known. However, when the compound powder containing B are not added S to blended powder containing iron alloy powder with no S and was sintered, the graphite powder completely diffuses into iron particles (i.e., which are graphiteized) during sintering, so that 1% free graphite by weight or more cannot be produced in the sintered article. Therefore compound powders containing B are added to act as a complex with S in the atomized alloy iron powder, to increase free graphite in the sintered article, thereby improving the sliding property. The compound powder containing B are preferably a hexagonal BN powder, a $H_3BO_3$ powder, a $B_2O_5$ powder, and an ammonium borate powder. With a content below 0.01% in terms of B, the amount of free graphite required to improve the sliding property cannot be obtained in the sintered article. When the amount exceeds 1.0% in terms of B, the compressibility is reduced and thus the impact valve of the sintered article is decreased. For this reason, the blended amount of one or more types of the compound powder containing B was limited to 0.01 to 1.0% by weight in terms of B.

The Blended Amount of the Ni Powder: 1 to 10% by Weight

The Ni powder is added to increase strength and toughness. The Ni powder is added, thereby improving the hardening property of the base. In addition, the sintering density is increased and the toughness is improved. With a content of the Ni powder below 1% by weight, no effect is recognized. A blended amount of the Ni powder above 10% by weight would raise no problem in property but cause a disadvantage in cost. For this reason, the blended amount of the Ni powder was limited to 1 to 10% by weight.

The Blended Amount of the Cu Powder: 1 to 6% by Weight

The Cu powder is added to increase toughness in the same way as the Ni powder. The addition of the Cu powder causes a liquid phase to be produced during sintering to strengthen the bond between iron particles, thereby improving the impact value. However, an excessive amount of the Cu powder would cause the binder phase portion to be weakened, thereby reducing toughness. With a blended amount of the Cu powder below 1% by weight, no effect is recognized. A blended amount of the Cu powder above 6% by weight would cause the toughness reduce. For this reason, the blended amount of the Cu powder was limited to 1 to 6% by weight.

The Blended Amount of the Graphite Powder: 1.3 to 3.0% by Weight

The graphite powder is added as the source of free graphite in the sintered article. An additional 1.3 to 3.0% by weight is preferable with respect to the total amount of the iron powder, the compound powder containing B, the Ni powder, the Cu powder, and the carbon powder. With a blended amount of the carbon powder below 1.3% by weight, a lesser amount of free graphite is found less in the sintered article, thus reducing the sliding property. On the other hand, with a blended amount of the carbon powder above 3.0% by weight, the toughness is reduced. For this reason, the blended amount of the carbon powder was limited to 1.3 to 3.0% by weight.

The blended amount of the lubricant: 0.5 to 2.0 parts by weight As the lubricant, zinc stearate, lithium stearate, ethylene (bis stearamide), stearic acid, or the like is preferably used.

A blended amount of the lubricant below 0.5 parts by weight cause a ejection to increase, making formation difficult. On the other hand, a blended amount of the lubricant above 2.0 parts by weight causes the green density to decrease. For this reason, the blended amount of the lubricant was limited to 0.5 to 2.0 parts by weight.

In the present invention, the compound powder containing B and the graphite powder are adhered to the surface of the atomized alloy iron powder by means of a lubricant. In order to allow the compound powder containing B and the graphite powder to adhere to the surface of the atomized alloy iron powder by means of a lubricant, the composition of the molten steel to be atomized is adjusted to obtain the atomized alloy iron powder having the aforementioned composition. Thereafter, for example, the manufacturing process shown below may be employed.

A liquid fatty acid is first blended to the atomized alloy iron powder at room temperature. Then, secondly, the compound powder containing B, the carbon powder, the Ni powder, the Cu powder, and metallic soap are added to blend together. During or after the second blend, the temperature is raised to allow a eutectic melt of the fatty acid and the metallic soap to be produced. Subsequently, being cooled during the third blending, the compound powder containing B and the carbon powder are fixedly adhered to the surface of the iron powder particles by the bonding force of the eutectic melt. Furthermore, at the time of cooling, the metallic soap powder or/and wax powder is added to carry out the fourth blending. The Ni powder and the Cu powder may not added for the second blending but added for the fourth blending.

Alternatively, the process may be carried out as follows. For the first blending, the compound powder containing B, the graphite powder, the Ni powder, the Cu powder, and two or more types of wax having different melting points are added to the atomized alloy iron powder. During or after the first blend, the temperature is raised to allow a partial melt of the wax to be produced. Subsequently, being cooled during the second blending, the compound powder containing B and the carbon powder are fixedly adhered to the surface of the iron powder particles by the bonding force of the partial melt. Furthermore, at the time of cooling, the metallic soap powder or wax powder is added to carry out the third blending. The Ni powder and the Cu powder may not be added for the first blending but added for the third blending.

The blended powder of the present invention is not limited to the above manufacturing method.

In the blended powder of the present invention manufactured as described above, the ratio of adhesion of the compound powder containing B and the carbon powder to the atomized alloy iron powder is preferably 50% or more. This is because the ratio of adhesion below 50% of the compound powder containing B and the carbon powder to the atomized alloy iron powder would provide significant variations in the sliding property. Here, the ratio of adhesion was determined as in the embodiment.

PREFERRED EMBODIMENT TO CARRY OUT THE INVENTION

Embodiment

The chemical composition of the atomized alloy iron powders that were used in the present invention is shown in Table 1. These atomized alloy iron powders were obtained as follows. A melt (the temperature of the molten steel is 1700° C.), which is adjusted so as to have a predetermined composition is water atomized to obtain an atomized alloy iron powder. The powder is then dried in a nitrogen atmosphere at a temperature of 140° C. for 60 minutes. Thereafter, reduction processing was performed in a vacuum at a temperature of 1150° C. for 20 minutes. After having been cooled down, the powder was taken out of the furnace to be powdered and classified.

The atomized alloy iron powders were blended with the Ni powders, the Cu powders, the compound powder containing B, and the graphite powders, of which blend is shown in Table 1, and the lubricant having the blend shown below in accordance with the blending method shown below in order to form blended powders. These blended powders were compacted to form cylindrical moldings having a green density of 6.70 g/cm$^3$. The moldings were then subjected to sintering processing in an RX gas atmosphere at a temperature of 1130° C. for 20 minutes to obtain sintered articles. Using these sintered articles, the content of free carbon, the impact value, the sliding property, and possibility of reformation were evaluated.

Blending Method A (1) Oleic acid 0.3% by weight was sprayed to an atomized alloy iron powder and was uniformly blended together for 3 minutes at room temperature, (2) Thereafter, a compound containing B, a graphite powder, a Ni powder, and a Cu powder, with the amount shown in Table 1, and stearic acid 0.4 parts by weight with respect to 100 parts by weight of the total amount thereof were added to the atomized alloy iron powder. Then, they were blended thoroughly and thereafter heated at a temperature of 130° C. while being continuously blended, (3) Being further blended, the blend was cooled down to 85° C. or less in order to obtain a blended powder by fixedly adhering at least the carbon powder and the compound powder containing B to the iron powder particles by means of the eutectic bonding agent of the oleic acid and the stearic acid.

(4) Furthermore, zinc stearate 0.3 parts by weight with respect to 100 parts by weight of the total amount the iron powder, the compound powders containing B, the graphite powder, and the Ni powder and the Cu powder having the amount shown in Table 1 were added to the blended powder. Then, they were blended uniformly.

Blending Method B (1) A compound containing B, a graphite powder, a Ni powder, and a Cu powder, with the amount shown in Table 1, a mix of stearamide and ethylene (bis stearamide) 0.4 parts by weight with respect to 100 parts by weight of the total amount thereof were added to the atomized alloy iron powder. Then, they were blended thoroughly and thereafter heated at a temperature of 110° C. while being continuously blended, (2) Being further blended, the blend was cooled down to 85° C. or less in order to obtain a blended powder by fixedly adhering at least the graphite powder and the compound powder containing B to the iron powder particles by means of the partial eutectic bonding agent of the stearamide and ethylene (bis stearamide).

(3) Furthermore, zinc stearate 0.3 parts by weight with respect to 100 parts by weight of the total amount the iron powder, the compound powders containing B, the carbon powder, and the Ni powder and the Cu powder having the amount shown in Table 1 were added to the blended powder. Then, they were blended uniformly.

Blending Method C

As a comparative prevention example, without performing the aforementioned segregation processing, a Ni powder, a Cu powder, a graphite powder, and a compound containing B, with the amount shown in Table 1, and zinc stearate 1 part by weight with respect to 100 parts by weight of the total amount thereof were added to the atomized alloy iron powder and blended together in a V blender for 15 minutes.

The content of the free graphite in the sintered article was determined by the infrared-absorbing analysis method using the residue obtained by filtering with a glass filter a residue provided after part of the sample of the aforementioned sintered article was dissolved with nitric acid.

As for the impact value, the aforementioned sintered article was formed into five Charpy test specimens, with no notch, 10 mm in thickness, 10 mm in width, and 55 mm in length. Then, the Charpy impact test was performed at room temperature to determine the average value of the absorbing energy of the five specimens.

The maximum allowable load was determined as follows. The aforementioned sintered article was formed into a cylindrical test piece having an inner diameter of 10 mm $\phi\times$ an outer diameter of 20 mm $\phi\times$ a height of 8 mm. A S45C made shaft having a diameter of 10 mm $\phi$ was inserted into the cylindrical test piece with a clearance of 20 μm. Then, the shaft was rotated at a peripheral speed of 100 m/min under the condition of dried friction. By employing the method for varying stepwise the contact load from low load to high load between said cylindrical test piece and the shaft, the maximum allowable load of the sintered article was determined to be the surface pressure Goad divided by the projected area) at which the shaft and the inner wall of the cylinder started sticking. The maximum allowable load was defined by (the applied force when sticking occurred)/(area). The greater the value, the better the sliding property. This test was performed on ten cylindrical test pieces formed from the sintered article to determine the average and variation (standard deviation $1\sigma$) in sliding property.

The reformation of the sintered article was determined to be possible by measuring the Rockwell hardness (HRB) of the sintered article and if the hardness was HRB 94 or less.

The adhesion ratio of the carbon was determined by dividing the quantity of particles with an analyzed value of C that passed through the 100 mesh screen but not the 200 mesh screen (75 to 150 μm in a particle diameter) with the quantity of particles with an analyzed value of C in the total amount of the iron based blended powder. In addition, the adhesion ratio of a boron determined by dividing the analyzed value of B of the particles classified with the same mesh by the analyzed value of B of the whole blended powder.

The Table 1 lists the content of free graphite in the sintered article, the impact value, the sliding property, the variation (standard deviation $1\sigma$) in sliding property, the possibility of reformation of the sintered article, the adhesion ratio of the carbon powder, and the adhesion ratio of the compound containing B.

As can be seen in Table 1, by the sintering using the blended powder for powder metallurgy according to the present invention, a reformable sintered article have been obtained which has the impact value not less than 6J, a good impact resistance, a good sliding property with an average value not less than 7.0 kgf/cm$^2$ and a variation not more than 1.0 kgf/cm$^2$ at $1\sigma$. Moreover, the adhesion ratio of carbon powder exceeds 50%.

In contrast, in the comparative examples in Table 2, as shown in comparative example 1, 3, and 5, the sliding property shows low values with less content of free graphite when less content of S and compound powder containing B is found, and when more content of Mn is found. Moreover, as shown in comparative example 2 and 4, the impact value is low when more content of S and compound powder containing B is found. As shown in comparative example 6, the sliding property is reduced when less content of Cr is found. As shown in comparative example 7, the article cannot be reformed and has a low impact value when much content of Cr is found. As shown in comparative example 8, 9, and 10, the impact value is reduced when Ni powder is not contained, when the content of Cu is less than set forth in the claim, or when the content of Cu is greater than set forth in the claim. As shown in comparative example 11, the adhesion ratio of carbon and boron is below 50% and the variation in sliding property becomes significantly greater compared with other comparative examples when the segregation prevention process was not performed.

APPLICABILITY IN INDUSTRY

According to the present invention, a sintered article can be obtained which is reformable, has a good impact resistance, and a good sliding property with less variation.

TABLE 1

| | Sintered article No. | Composition of atomized alloy iron powder (wt %) S | Cr | Mn | Mo | V | Blended alloy powder (wt %) Ni powder | Cu powder | Blended graphite powder | Compound in powder containing B (in terms of B) BN powder | $H_3BO_3$ powder | $B_2O_5$ powder | Ammonium borate powder | Blending method | Adhesion ratio (%) B | C | Property of sintered article: Content of free graphite % | Impact value J/cm$^2$ | Sliding property: Average kgf/cm$^2$ | Variation 1 σ | Possibility of reformation |
|---|---|---|---|---|---|---|---|---|---|---|---|---|---|---|---|---|---|---|---|---|---|
| Example of the invention | 1 | 0.25 | 0.6 | 0.05 | | | 4.00 | 1.00 | 2.0 | 0.11 | | | | A | 65 | 70 | 1.6 | 7 | 10.0 | 0.9 | Possible |
| | 2 | 0.12 | 1.0 | 0.10 | | | 6.00 | 2.00 | 2.0 | | | 0.05 | | A | 60 | 75 | 1.5 | 7 | 9.0 | 1.0 | Possible |
| | 3 | 0.14 | 1.5 | 0.20 | | | 8.00 | 3.00 | 1.4 | 0.12 | | | | A | 65 | 70 | 1.2 | 9 | 9.0 | 1.0 | Possible |
| | 4 | 0.16 | 2.0 | 0.80 | | | 4.00 | 2.00 | 1.5 | 0.60 | | | | B | 60 | 65 | 1.4 | 7 | 9.0 | 0.9 | Possible |
| | 5 | 0.24 | 2.5 | 0.15 | | | 3.00 | 4.00 | 2.0 | | 0.90 | | | A | 70 | 70 | 1.8 | 7 | 9.0 | 0.9 | Possible |
| | 6 | 0.13 | 3.0 | 0.05 | | | 2.00 | 1.50 | 2.0 | | 0.14 | 0.02 | | A | 67 | 66 | 1.7 | 8 | 9.0 | 1.0 | Possible |
| | 7 | 0.10 | 3.7 | 0.04 | | | 4.00 | 5.00 | 2.0 | | | 0.20 | | B | 60 | 65 | 1.5 | 7 | 8.0 | 0.8 | Possible |
| | 8 | 0.08 | 1.0 | 0.10 | 0.30 | 0.30 | 6.00 | 2.00 | 2.0 | 0.08 | | | | A | 70 | 70 | 1.6 | 8 | 8.0 | 1.0 | Possible |
| | 9 | 0.13 | 1.0 | 0.80 | 0.30 | | 4.00 | 2.00 | 2.0 | 0.20 | | | | A | 65 | 75 | 1.4 | 8 | 8.0 | 1.0 | Possible |
| | 10 | 0.15 | 1.5 | 0.10 | 0.10 | | 3.00 | 3.00 | 2.0 | | | 0.12 | | A | 60 | 70 | 1.4 | 7 | 7.0 | 0.9 | Possible |
| | 11 | 0.18 | 1.5 | 0.15 | 1.00 | | 6.00 | 2.00 | 2.5 | 0.25 | | | | B | 65 | 65 | 2.1 | 9 | 10.0 | 0.9 | Possible |
| | 12 | 0.22 | 2.0 | 0.20 | 2.50 | | 4.00 | 2.00 | 2.0 | | | | 0.14 | A | 60 | 70 | 1.6 | 8 | 8.0 | 1.0 | Possible |
| | 13 | 0.15 | 2.0 | 0.10 | | 0.10 | 6.00 | 1.00 | 2.0 | 0.10 | | | | A | 70 | 66 | 1.5 | 8 | 9.0 | 1.0 | Possible |
| | 14 | 0.10 | 3.0 | 0.08 | 0.30 | 0.30 | 4.00 | 3.00 | 2.0 | 0.80 | | | | A | 65 | 65 | 1.8 | 8 | 8.0 | 0.9 | Possible |
| | 15 | 0.20 | 3.5 | 0.10 | 0.30 | | 2.00 | 4.00 | 2.8 | 0.05 | | | | B | 60 | 65 | 2.4 | 7 | 12.0 | 1.0 | Possible |
| | 16 | 0.25 | 2.0 | 0.08 | 5.00 | | 5.00 | 2.00 | 2.0 | | | 0.10 | | B | 70 | 70 | 1.5 | 6 | 7.0 | 0.9 | Possible |
| | 17 | 0.12 | 1.0 | 0.10 | 0.10 | 0.60 | 2.00 | 3.00 | 2.0 | | | | 0.10 | A | 65 | 65 | 1.5 | 6 | 8.0 | 0.9 | Possible |

TABLE 2

| | Sintered article No. | Composition of atomized alloy iron powder (wt %) S | Cr | Mn | Mo | V | Composition of atomized alloy iron powder (wt %) Ni powder | Cu powder | Blended graphite powder (%) | Compound powder containing B (in terms of B) BN powder | $H_3BO_3$ powder | $B_2O_5$ powder | Ammonium borate powder | Blending method | Adhesion ratio (%) B | C | Property of sintered article: Content of free graphite % | Impact value J/cm² | Sliding property: Average kgf/cm² | Variation 1 σ | Possibility of reformation |
|---|---|---|---|---|---|---|---|---|---|---|---|---|---|---|---|---|---|---|---|---|---|
| Comparative example | 1 | 0.01 | 0.5 | 1.00 | | | 5.00 | 2.00 | 2.0 | | 0.10 | | | A | 65 | 70 | 0.3 | 6 | 0.3 | 0.1 | Possible |
| | 2 | 0.35 | 2.0 | 0.60 | | | 3.00 | 1.00 | 2.0 | | | 0.12 | | B | 60 | 66 | 1.5 | 3 | 7.0 | 1.0 | Possible |
| | 3 | 0.10 | 1.0 | 0.05 | 2.00 | | 4.00 | 3.00 | 2.0 | 0.005 | | | | A | 65 | 65 | 0.1 | 6 | 0.2 | 0.05 | Possible |
| | 4 | 0.08 | 1.5 | 0.10 | 2.00 | 0.10 | 4.00 | 4.00 | 2.0 | | 1.50 | | | A | 60 | 70 | 1.6 | 3 | 8.0 | 0.9 | Possible |
| | 5 | 0.10 | 1.0 | 1.50 | | | 4.00 | 1.00 | 2.0 | | | 0.10 | | B | 70 | 75 | 0.2 | 6 | 0.3 | 0.1 | Possible |
| | 6 | 0.10 | 0.1 | 0.10 | | | 4.00 | 1.00 | 2.0 | 0.15 | | | | A | 65 | 70 | 1.5 | 4 | 5.0 | 0.8 | Possible |
| | 7 | 0.20 | 6.0 | 0.08 | 0.30 | | 2.00 | 2.00 | 2.0 | | 0.15 | | | A | 60 | 75 | 1.6 | 3 | 7.0 | 1.0 | Impossible |
| | 8 | 0.24 | 2.5 | 0.15 | 0.10 | | 0.10 | | 2.0 | | 0.10 | | | A | 65 | 65 | 1.6 | 3 | 7.0 | 0.6 | Possible |
| | 9 | 0.24 | 2.5 | 0.15 | | | * | 0.10 | 2.0 | 0.08 | | | | B | 70 | 65 | 1.5 | 3 | 8.0 | 0.5 | Possible |
| | 10 | 0.24 | 2.5 | 0.15 | | 0.10 | * | 8.00 | 2.0 | | | 0.10 | | A | 65 | 70 | 1.5 | 2 | 7.0 | 0.6 | Possible |
| | 11 | 0.14 | 1.5 | 0.20 | | | 8.00 | 3.00 | 2.0 | 0.12 | | | | C | 15 | 20 | 1.5 | 8 | 8.0 | 2.1 | Possible |

What is claimed is:

1. An iron based blended powder for powder metallurgy, formed by blending an atomized alloy iron powder with 0.01% to 1.0% of one or more types of compound powder containing B in terms of B, 1 to 10% of Ni powder, 1 to 6% of Cu powder, 1.3 to 3.0% of graphite powder, by weight % with respect to the total weight of said atomized alloy iron powder, the compound powder containing B, the Ni powder, the Cu powder, and the carbon powder, as well as 0.5 to 2.0 parts by weight of a lubricant with respect to 100 parts by weight of said total weight, said iron based blended powder for powder metallurgy wherein said atomized alloy iron powder comprises, by weight %, 0.03 to 1.00% of Mn, 0.5 to 4.0% of Cr, 0.03 to 0.3% of S, and the residue of Fe and unavoidable impurities, said compound powder containing B and said graphite powder being adhered by means of said lubricant to surfaces of said atomized alloy iron powder.

2. An iron based blended powder for powder metallurgy according to claim 1, further containing one or two types of elements selected from the group consisting of 0.05% to 3% of Mo and 0.1 to 0.5% of V.

3. An iron based blended powder for powder metallurgy according to claim 1 or 2, wherein said blended powder satisfies the following equations of (1) and (2):

$$\text{the content of C of a blended powder 75 to 150 } \mu\text{m in a particle diameter/the content of C of the whole blended powder} \geqq 0.5 \quad (1),$$

and $$\text{the content of B of a blended powder 75 to 150 } \mu\text{m in a particle diameter/the content of B of the whole blended powder} \geqq 0.5 \quad (2).$$

* * * * *